United States Patent [19]

Miller, Jr.

[11] Patent Number: 4,781,567

[45] Date of Patent: Nov. 1, 1988

[54] COMPACTION EVALUATION APPARATUS

[75] Inventor: Henry A. Miller, Jr., Lake Hopatcong, N.J.

[73] Assignee: Warner-Lambert Company, Morris Plains, N.J.

[21] Appl. No.: 113,301

[22] Filed: Oct. 28, 1987

[51] Int. Cl.[4] ..... B28B 1/04

[52] U.S. Cl. ..... 425/406; 264/DIG. 37; 425/172; 425/419; 425/423; 425/469; 425/804

[58] Field of Search ..... 425/406, 419, 421, 423, 425/410, 469, 804, 140, 169–173; 264/DIG. 37

[56] References Cited

U.S. PATENT DOCUMENTS

| | | | |
|---|---|---|---|
| 1,541,967 | 6/1925 | Klinkenstein et al. | 264/DIG. 37 |
| 2,900,664 | 8/1959 | Hampel et al. | 425/423 X |
| 3,179,998 | 4/1965 | Lamb | 425/419 X |
| 3,397,424 | 8/1968 | Rovde et al. | 425/419 |
| 3,719,445 | 3/1973 | Sindelar | 425/419 X |
| 3,794,458 | 2/1974 | Iwasaki et al. | 425/423 X |
| 3,883,278 | 5/1975 | Hass | 425/419 X |
| 4,363,612 | 12/1982 | Walchhutter | 425/419 X |
| 4,534,721 | 8/1985 | Iwasaki et al. | 425/406 X |

OTHER PUBLICATIONS

Bosch, Robert; GmbH Instruction Manual, pp. 2–12; Aug., 1977.

*Primary Examiner*—Richard L. Chiesa

*Attorney, Agent, or Firm*—Pollock, Vande Sande & Priddy

[57] ABSTRACT

A compaction evaluation apparatus for determining powder plug and compaction force parameters to produce a desired plug for encapsulation. A tamping pin is operated by a piston, and the force applied by the pin as well as its dwell on the powder plug can be accurately controlled. The powder plug may be released into an actual capsule body.

4 Claims, 4 Drawing Sheets

FIG. 2
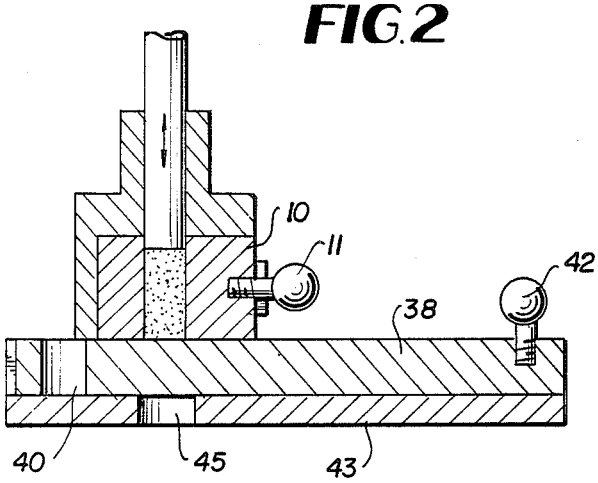
FIG. 3
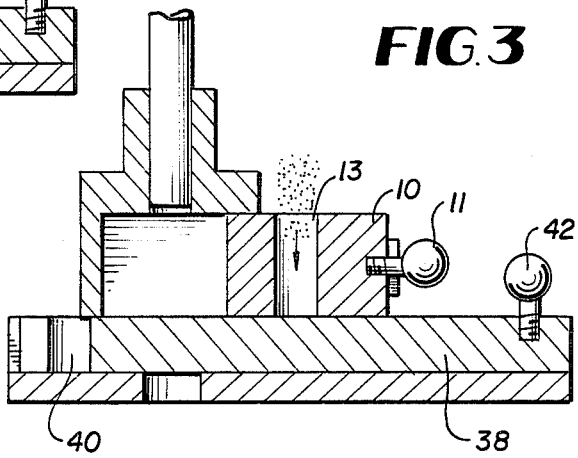
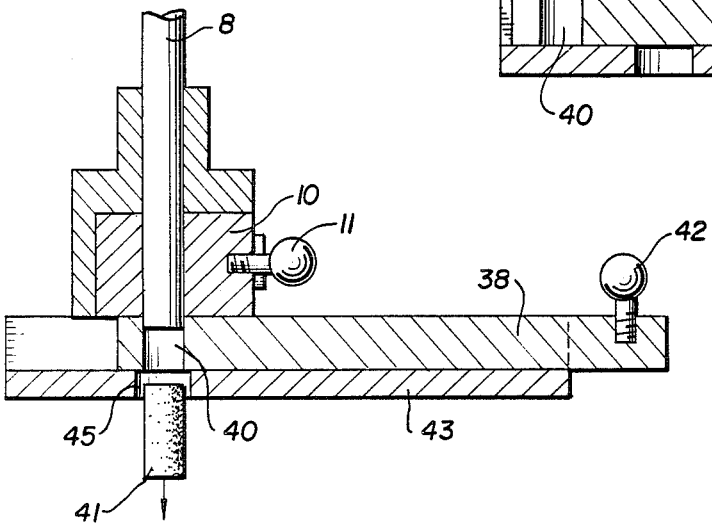
FIG. 4
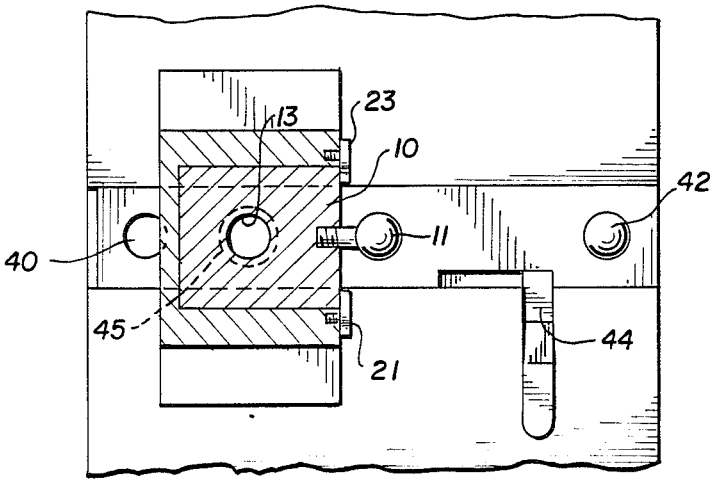
FIG. 5

COMPACTION EVALUATION APPARATUS

The present invention is directed to compaction evaluation apparatus for determining powder plug and compaction force parameters to produce a desired powder plug for encapsulation.

In the manufacture of medicinal capsules, capsule bodies are filled with powder by automatic capsule filling apparatus. In such apparatus, a tamping pin is arranged to tamp the powder in the capsule body to a desired height.

The apparatus of the present invention is utilized to evaluate the amount of powder which should be used in the capsule body to produce a desired plug and also the preferred compaction force, cycle and dwell time. Use of the present invention thus permits an evaluation of relevant parameters before actual production in a capsule filling machine begins, so as to advantageously select and control such parameters with use of the capsule filling equipment.

A rudimentary type of compaction evaluation apparatus is known in the prior art. In such apparatus, a hand operated plunger is depressed to move a tamping pin into contact with powder which is disposed in a bushing. The pressure applied is registered on a gauge and the height of the resultant plug is measured and displayed.

In the prior art apparatus, neither the pressure applied to the tamping pin nor the dwell of the pin on the plug when successive, cyclical tamps are utilized can be conveniently or accurately controlled. Additionally, no provision is made for release of the powder plug into an actual capsule body, for example, if it is desired to perform dissolution tests on same.

In accordance with the present invention, an apparatus is provided which enables accurate control of the pressure which is applied by the tamping pin. Additionally, the apparatus can be operated in either a hold mode wherein the height of the plug is measured after a single tamp, or in a cycle mode wherein the height is measured after a series of successive tamps, and in such cycle mode the dwell of the tamping pin may be accurately set. Additionally, in accordance with a feature of the invention, the powder plug which is formed may be released into a capsule body, and thereafter used for dissolution studies if desired.

It is thus the object of the present invention to provide an improved compaction evaluation apparatus.

The invention will be better understood by referring to the following drawing figures.

BRIEF DESCRIPTION OF THE DRAWINGS

FIG. 2 is a cross-section taken at lines 2—2 of FIG. 1, and shows the die and anvil in the operating position.

FIG. 3 is a cross-section similar to FIG. 2 wherein the die is shown in its retracted position.

FIG. 4 is a cross-section similar to FIG. 2 wherein the die and anvil are shown in the plug ejection position.

FIG. 5 is a top view taken on lines 5—5 of FIG. 1, wherein the die and anvil are shown in the operating position.

DETAILED DESCRIPTION OF THE DRAWING

Figure 1:
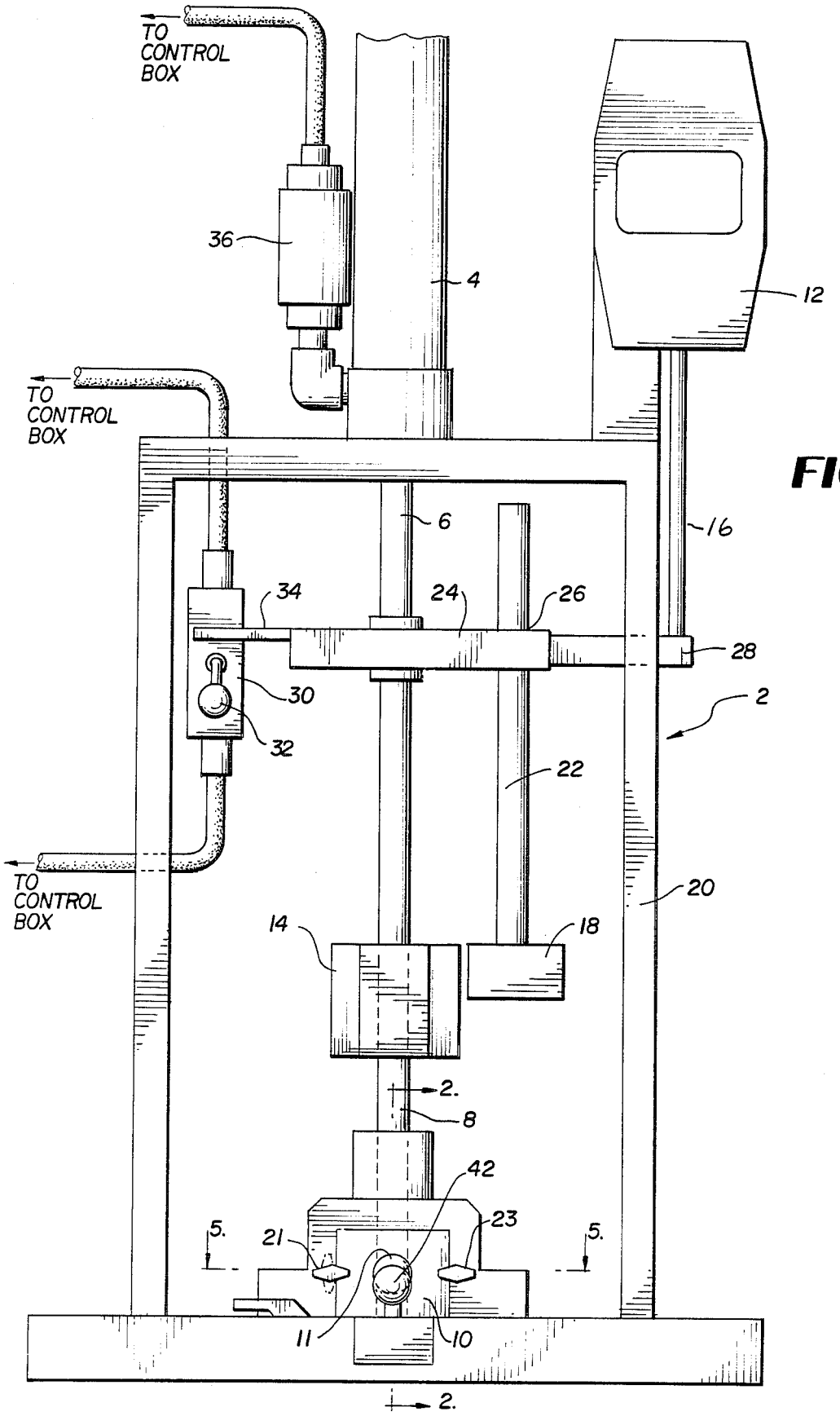
FIG. 1 is a pictorial representation of an embodiment of the invention.

Referring to FIG. 1, a compaction evaluation unit 2 in accordance with the invention is depicted.

Cylinder 4 and piston rod 6 cause tamping pin 8 to move downwardly and strike a powder formulation which is housed in die 10 with an accurately controlled force. The height of the resultant powder plug is measured by indicator 12, and the results may be used to control the amount and formulation of powder as well as strike force and dwell parameters when the drug powder is actually processed by an automatic capsule filling machine having characteristics which are similar to the evaluation unit.

Referring further to FIG. 1, pressurized air is fed to the top of cylinder 4 and causes piston rod 6 to move downwardly. The piston rod is connected to tamping pin 8 by mechanical connector 14, and the tamping rod may be tapered, and has the same shape and size as the tamping rod which would be used as the automatic capsule filling equipment.

Indicator 12 is a conventional displacement indicator and has a displacement rod 16 extending therefrom. Block 18 is secured to the back of housing 20 and has guide rod 22 extending therefrom. Piston rod 6 has horizontal member 24 mounted thereon which has a bearing-containing hole at reference numeral 26 for reciprocating on guide rod 22 as the piston moves up and down.

Member 28 extends from member 24 and moves down the same amount as the piston. Displacement rod 16 rests on member 28, and so when the tamping rod rests on the powder plug, indicator 12 provides an indication of plug height.

Pneumatic safety switch 30 has switch member 32 extending therefrom, and horizontal member 34 which extends from member 24 trips the switch member on the downward stroke of the piston. As will be explained more fully below, this causes the piston to automatically reciprocate upwardly after tamping has occurred.

Outlet valve 36 is connected to the bottom of cylinder 4, and as will be discussed below, the outlet valve as well as the pneumatic safety switch are connected to a control box.

Referring to FIG. 3, die 10 is shown in the retracted position, to which it is moved by pulling handle 11. In this position, hole 13 in the die is filled with the powder formulation to be tamped. The die is then returned to the operating position which is shown in FIG. 2. In this position, the bottom of the die rests against anvil 38, and the die is held in this position by rotating screws 21 and 23, shown in FIGS. 1 and 5 to the horizontal position. Anvil 38 is also in the operating position, that is pushed forward so that hole 40 is in front of the powder plug, and the powder is tamped against the solid surface of the anvil. Knob 42 is used to slide the anvil from the operating to the retracted position, and stop 44, shown in FIG. 5, defines these positions.

FIG. 4 shows the anvil 38 in the retracted or plug ejection position. In this position, hole 40 in the anvil is in line with die hole 13 and with hole 45 in bottom plate 43, and the tamping pin 8 is moved downwardly to eject the powder plug 41.

Figure 6:
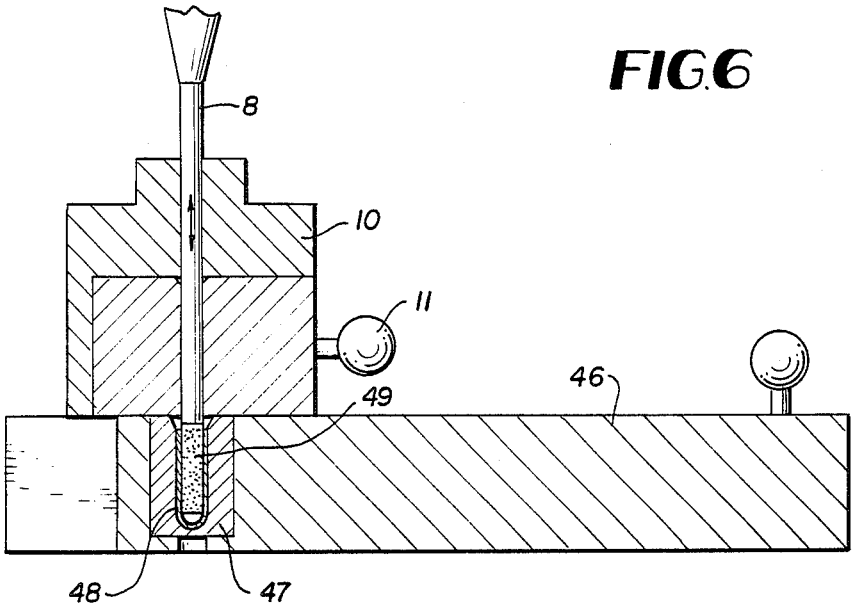
FIG. 6 shows an embodiment of the invention wherein the anvil has a capsule body bushing mounted therein for receiving a capsule body.

Referring to FIG. 6, a further embodiment of the invention is shown, wherein tee powder plug is ejected into a capsule body. In this embodiment, anvil 46 has capsule body bushing 47 disposed therein, which houses a capsule body 48. The powder plug is ejected into the capsule body, which is then withdrawn from the anvil.

This embodiment is very useful, as the resulting capsule can be used for dissolution studies, i.e., to see how the compacted powder dissolves. e.g., as it would in a patient's stomach.

Figure 7:
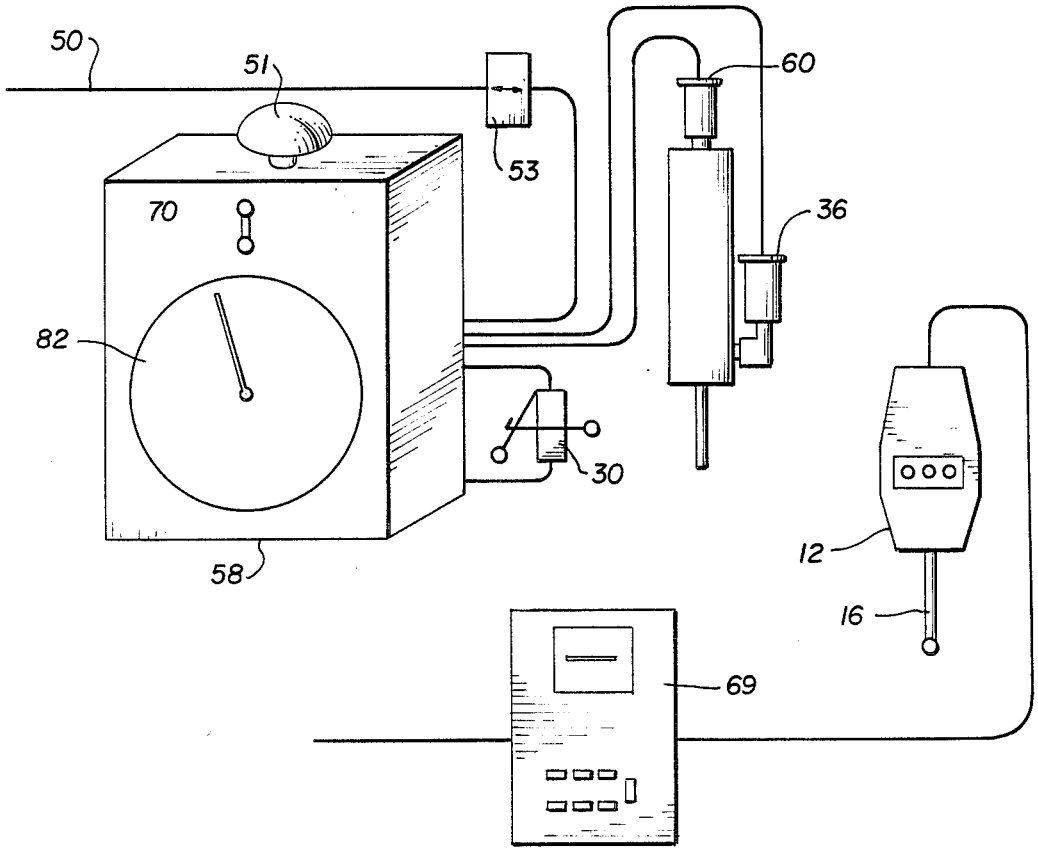
FIG. 7 is a pictorial representation which shows the interconnection of the various parts of the apparatus.

FIG. 7 shows a pictorial overview of the system for operating the piston and measuring the height of the tamped plug.

A control box 58 is provided which includes a pressure gauge 82 which displays the pressure for driving the piston downwardly, as well as actuator button 51 and cycle/hold switch 70. Each time a tamping stroke is desired, actuator button 51 is depressed, and the force of the stroke is controlled by adjusting pressure regulator 53. In the embodiment depicted, when the cycle/hold switch is in the cycle position, a number of successive tamps is effected by successive depressions of actuator button 51, with the piston being automatically driven upwardly after each tamp as explained below. In the hold position, the tamping pin remains in the down position against the plug until the pneumatic safety switch 30 and cycle/hold switch are manually operated as explained below.

Figure 8:
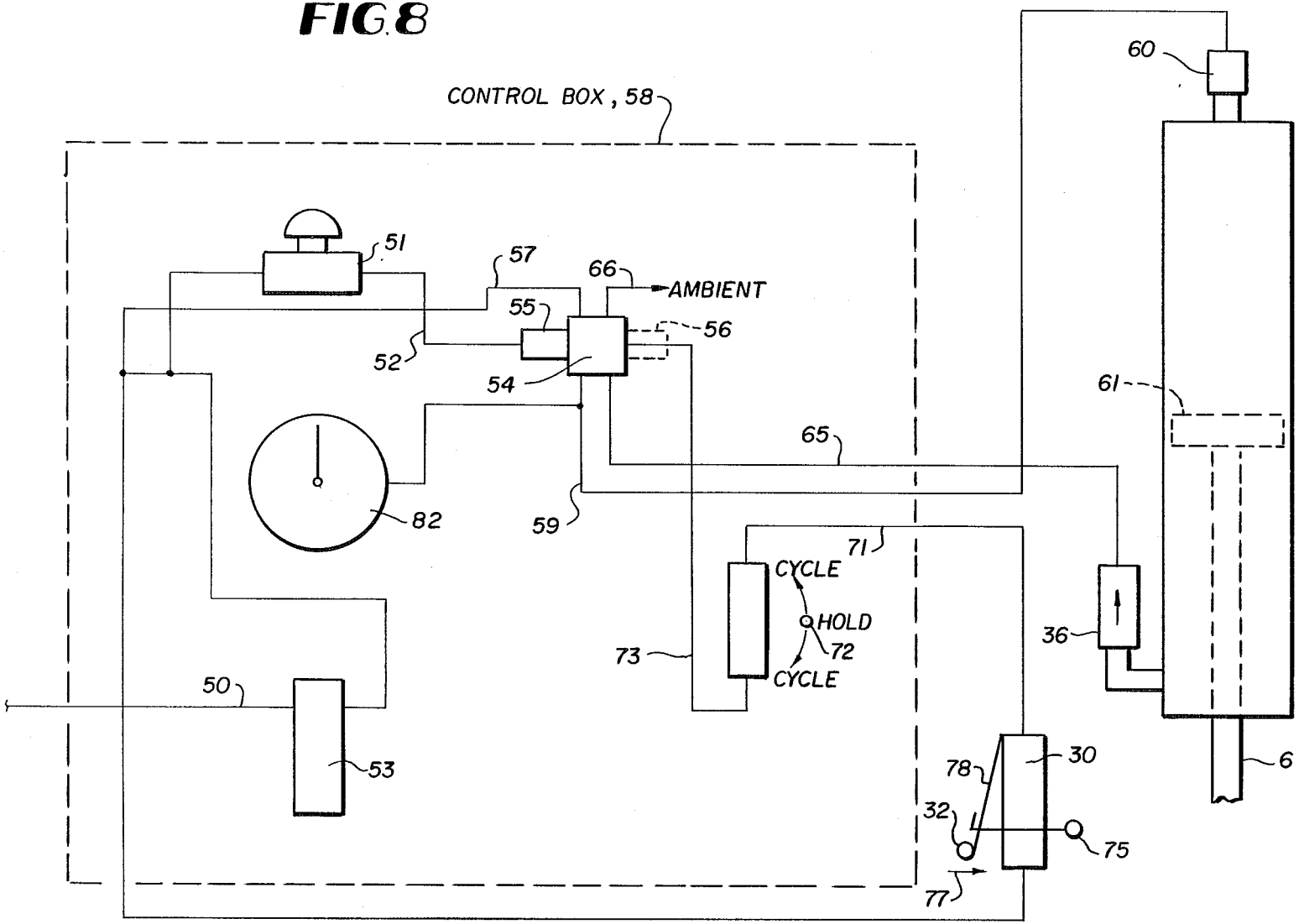
FIG. 8 is a schematic diagram of an embodiment of the pneumatic circuit for effecting reciprocation of the tamping pin.

Referring to FIG. 8, the pneumatic circuit for accomplishing the above-described operations will now be described. In FIG. 8, line 50 connects a supply of pressurized air (not shown) to the actuator button 51 through a pressure regulator 53. Upon pushing actuator button 51, air pressure through line 52 causes a slide valve 55 in a manifold 54 to assume the position illustrated by broken lines 56. With the slide valve in position 56, pressurized air in line 57 is connected to the top of cylinder 58 via an internal passageway (not shown) in manifold 54, and then through line 59, and upper valve 60, which may be adjusted to regulate the rate of air flow into or out of the cylinder. As air enters the top of cylinder 4, piston 61 and the attached connecting rod 6 are forced downward to cause tamping of powder in the die. As piston 61 moves downward, air on its lower side is forced out to ambient pressure through a lower valve 64 which is connected to an air release line or vent 66 via a line 65 and an internal passageway of manifold 54. Lower valve 64 is adjustable in the same manner as upper valve 60.

As the piston 61 reaches its downward limit of travel, a projecting portion of the tamping mechanism trips a pneumatic safety switch 30 which when opened connects air pressure in line 68 to toggle switch 70 via a line 71. Safety switch 30 is automatically opened by the downward travel of the tamping mechanism which causes its projecting member to engage a sliding contact member 32 to push it inward in the direction indicated by arrow 77 so as to open the valve of safety switch 30 when the tamper mechanism is in its downwardmost position. The valve of safety switch 67 is biased toward its closed position in the direction opposite to arrow 77 by a biasing member, such as a leaf-spring 78.

When the toggle 72 of switch 70 is in the cycle position, switch 70 also is open to connect air pressure in line 71 with the slide valve 55 through a line 73 so as to cause the slide valve to move from its broken line position 56 to its solid line position shown in the drawing. When the slide valve has been so moved to its solid line position, air pressure in line 57 is connected to the lower end of cylinder 58 through line 65 and valve 36. The introduction of this air pressure below piston 61 drives piston 61 to the upper end of cylinder 58, thereby forcing air above piston 61 to ambient pressure through valve 60, line 59, and vent 66, there being a corresponding passageway (not shown) in manifold 54 connecting the port for line 59 to the port for vent 66.

When the toggle 72 of switch 70 is in the hold position, the air pressure in line 68 cannot reach the slide valve 55 to move it from its position 56 because toggle switch 70 is closed. In other words, with toggle 72 in the hold position, air does not reach the slide valve 55 through toggle switch 70 and line 73 when safety switch 67 is opened by the downward travel of the tamping mechanism. Manual actuation of slide valve 55 from its broken line position 56 to its solid line position may be accomplished by moving toggle 72 to the cycle position and then manually tripping safety switch 30 by pulling knob 75.

An air gauge 82 registers only the air source pressure while the tamper mechanism is being driven downwardly by the pressurization of line 59. As the tamping mechanism is retracted upwardly by piston 61, air gauge 82 indicates approximately the value of atmospheric pressure.

The compaction evaluation apparatus of the invention is designed to make a suitable plug for encapsulation using the minimal amount of drug. The compaction forces and heights for plugs are monitored. Additionally, the unit is capable of controlling the compaction force of the tamping pin by adjustment of the pressure regulator, and in the cycle mode of simulating dwell times used on automatic capsule fillers. This is accomplished by adjusting the inlet and outlet valves 60 and 36 and is done to achieve a direct correlation with the automatic capsule filler.

To operate the apparatus, the required amount of material to be encapsulated is placed into the die for compaction. At this point the tamping pin is engaged for compaction after predetermined dwell and pressure regulator settings are effected. With the toggle switch set in the hold position the tamping pin comes to rest on the material to create a plug. At this time a reading is taken on the digital micrometer 12 giving the height of the plug in millimeters and the data is printed with the miniprocessor 69. To simulate the compaction cycle used on the automatic capsule filler, the toggle switch 70 is set in the cycle mode for a total of five tamps. A reading of the plug height is recorded on the miniprocessor after the last tamp. After the tamping operation has been completed the capsule plug is ejected through the die as heretofore discussed.

To determine the compaction height of the plug as it goes through the five compaction cycles the toggle switch is set in the hold position and as the tamping pin comes to rest on the powder creating a plug the plug height is recorded for each compaction. When using the hold position, the formulator is capable of observing the compaction of the plug for each step in the encapsulation cycle.

The height of the capsule plug is determined by the height of the capsule body, therefore when selecting a dosing disc for a automatic capsule filler the disc should be the same height as the capsule body or slightly larger. Based on the overall length of the capsule body, a dosing disc is selected. For instance, the capsule body length for a #3 capsule is 13.6 mm. Therefore a 14 mm dosing disc was chosen for Indomethacin 25 mg. capsules based on the length of the capsule body for #3 capsule.

Table I below is a comparison chart which compares the compaction evaluation unit with the H&K 1500 Automatic Capsule Filler.

TABLE I

| | H&K 1500 Automatic Capsule Filler | Compaction Evaluation Unit |
|---|---|---|
| Speed: | 91 rpm | 91 rpm |
| Fill Wt.: | 240 mg. | 240 mg. |
| Capsule: | #3 | #3 |
| Dosing Disc: | 14 mm | — |
| No. Tamps: | 5 | 1st - 14.6 mm<br>2nd - 14.52 mm<br>3rd - 14.40 mm<br>4th - 14.30 mm |
| Plug Height: | 14.20 mm | 5th - 14.30 mm |

As can be seen in Table I, the data acquired from the compaction evaluation unit is similar to resulting plug heights obtained on a H&K 1500 automatic capsule filler. Another point to note is the compaction evaluation unit enables the formulator to document capsule plug heights at each individual tamp to achieve better prospective of the final plug.

While the invention has been illustrated in connection with a preferred and illustrative embodiment, it is to be understood that variations will occur to those skilled in the art, and the scope of the invention is to be limited only by the claims appended hereto and equivalents.

I claim:

1. Compaction evaluation apparatus for determining desirable powder and compaction force parameters to produce a required plug for encapsulation, comprising, a tamping pin, a hollow body for accepting powder for forming a plug, pneumatic cylinder means connected to said tamping pin for causing a downward motion thereof into said hollow body for compressing said powder into a plug, means for supplying fluid under pressure to said pneumatic cylinder means for causing said downward motion, pressure regulator means for controlling the pressure of the fluid which is supplied to said pneumatic cylinder means, means for measuring the height of said powder plug, automatic cycling means for causing said pneumatic cylinder means to move said tamping pin upwardly away from said powder plug after tamping thereof, means for controlling the dwell of said tamping pin on said powder plug, which means comprises adjustable inlet and outlet valve means for said pneumatic cylinder, said hollow body for accepting said powder comprising a die having a cylindrical cavity therein, and an anvil disposed beneath said die, said anvil having an opening therein, and being movable between an operating position wherein said opening is not coaxial with the cylindrical cavity of said die and a plug removal position wherein said opening is coaxial with said cylindrical cavity of said die.

2. The apparatus of claim 1 wherein there is a bushing disposed in said opening in said anvil which is adapted for receiving a capsule body.

3. The apparatus of claim 1 wherein in addition to said automatic means, there is a manually activated means for causing said cylinder means to move said tamping pin upwardly, and selector switch means for selecting that the apparatus be operated in an automatic or a manual mode.

4. The apparatus of claim 1 wherein said means for measuring the height of said powder plug comprises a displaceable rod and mechanical indicating means for measuring and displaying the displacement of the rod, a member having a horizontal surface being mechanically linked to said tamping pin for movement therewith, and said rod being displaceable to said horizontal surface to provide an indication of said plug height.

* * * * *